US007536813B2

(12) United States Patent
Lueddecke

(10) Patent No.: US 7,536,813 B2
(45) Date of Patent: May 26, 2009

(54) SEGMENTED WAGON WHEEL DESIGN

(76) Inventor: Harold M. Lueddecke, 1303 W.N. Service Rd., Wright City, MO (US) 63390

( * ) Notice: Subject to any disclaimer, the term of this patent is extended or adjusted under 35 U.S.C. 154(b) by 743 days.

(21) Appl. No.: 10/461,946

(22) Filed: Jun. 14, 2003

(65) Prior Publication Data

US 2004/0020090 A1 Feb. 5, 2004

Related U.S. Application Data

(60) Provisional application No. 60/389,374, filed on Jun. 18, 2002.

(51) Int. Cl.
*G09F 21/04* (2006.01)

(52) U.S. Cl. ..... 40/587; 40/590; 301/30

(58) Field of Classification Search ..... 301/30, 301/31, 79, 64.704, 64.201, 64.202, 64.203; 40/587, 590

See application file for complete search history.

(56) References Cited

U.S. PATENT DOCUMENTS 916,009 A * 3/1909 Plummer ..... 301/31
1,316,382 A * 9/1919 Murray ..... 301/79
2,889,239 A * 6/1959 Meissner ..... 427/118
3,695,728 A * 10/1972 Haussels ..... 301/64.706

OTHER PUBLICATIONS

Wagon Wheel, Aug. 31, 2004, http://www.intergardenand more.com.*

Wagon Wheel Chanderlier Lighting, Aug. 31, 2004, □□http://www.horns-a-plenty.com/Level%202/wagon_wheel_chandeliers.htm.*

* cited by examiner

*Primary Examiner*—Cassandra Davis
(74) *Attorney, Agent, or Firm*—Paul M Denk

(57) ABSTRACT

A segmented wagon wheel design, formed of a series of segments incorporating a part of a felloe, one or more, but preferably, a pair of spokes, and a segment of a hub, molded as an integral structure, which when formed through the interconnection of a series of the segments together, into the shape of a wagon wheel, forms a segmented wagon wheel that appears to be seamless of design, and yet highly structured for implanting or resting upon the front lawn or business, for displaying other indicia such as the homeowner's name, an address, and other seasonal displays, as desired.

18 Claims, 9 Drawing Sheets

SEGMENTED WAGON WHEEL DESIGN

CROSS REFERENCE TO RELATION APPLICATION

This non provisional patent application is based upon the provisional patent application under Ser. No. 60/389,374, which was filed on Jun. 18, 2002.

BACKGROUND OF THE INVENTION

This invention relates generally to a decorative display item, and more particularly relates to a segmented wagon wheel design for use for adorning the front yard, or in front of a house, to provide for the display of an address, a seasonal decorative device, or simply just to provide the visual of an old fashioned wagon wheel, in the front yard of the residence.

Since the early days when the covered wagons moved west, and the old fashioned wood wagon wheels were highly in vogue, as the primary source of wheeled transportation. Since then, the wagon wheel has caught the attention and fancy of the North American populous. Frequently, as anyone can remember, and even currently on isolated occasions, when one drives out in the countryside, you will see a wagon wheel partially buried in the ground, sticking up from the front lawn, generally in the vicinity of the roadway, to provide a visual remembrance of the past, especially in rural settings.

The current invention is designed to provide an updated version of that type of display, which is segmented and designed, can be easily fitted together by the purchaser, ready for display in any yard, on the porch, or even in front of businesses and shops, and afford other visual displays to the delight of passersby.

SUMMARY OF THE INVENTION

This invention relates generally to a segmented wagon wheel display.

This invention contemplates the fabrication of an old style wagon wheel, preferably from a design segment of a wagon wheel, which can be interconnected with additional like segments to provide a complete circular wheel, having the aesthetics that make it look exactly like an old fashioned wagon wheel, once assembled. The wagon wheel, when assembled, includes means for facilitating the mounting of various seasonal displays, to the wheel, preferably at its upper end, or which simply may provide the name or address of the occupant of the residence or business, to provide that type of display in the front or other yard of the homeowner or business, when the assembled wheel is mounted during usage.

Each of the segments, in the preferred embodiment, include a segment of the hub, a pair of spokes, and a segment of the outer felle and rim, all of which are integrally molded as an individual unit, and which when assembled with six additional segments, on each side of the wheel, that may all be fastened together, such as through screws, or snap locks, into an entirely assembled wheel, which has the visual appearance of an actual old fashioned wagon wheel, in design.

It is, therefore, the principal object of this invention to provide a segmented wagon wheel that can be assembled into a lawn or garden, or business display, as desired.

Another object of this invention is to provide a segmented wagon wheel that may be assembled into a completely configured wheel, and incorporate means for mounting additional displays, such as the name of the homeowner, the address, or other seasonal ornamentation that may be readily replaced at the ebb of any season.

Still another object of this invention is to provide a pre fabricated wagon wheel formed from various segments that can be fastened together into a composite wagon wheel having the old fashioned appearance of a wheel of a covered wagon.

Still another object of this invention is to provide a wagon wheel that is easy in assembly, can be originally fastened together into the design of a unified wagon wheel, ready for use as a garden, lawn, or business display.

Still another object of this invention is to provide for segments of a wagon wheel, that incorporate various aspects of tongue and groove interconnection, and overlapping portions, so that when the multitude of the segments are assembled together, into a complete wagon wheel, it appears to be a unified structure, with minimum disclosure of any seams.

These and other objects may become more apparent to those skilled in the art upon review of the summary of the invention provided herein, and upon undertaking a study of the description of its preferred embodiment, in view of the drawings.

BRIEF DESCRIPTION OF THE DRAWINGS

In referring to the drawings, FIG. 1 discloses the wagon wheel of this design and displaying the name of the home occupant.

DESCRIPTION OF THE PREFERRED EMBODIMENT

Figure 1:
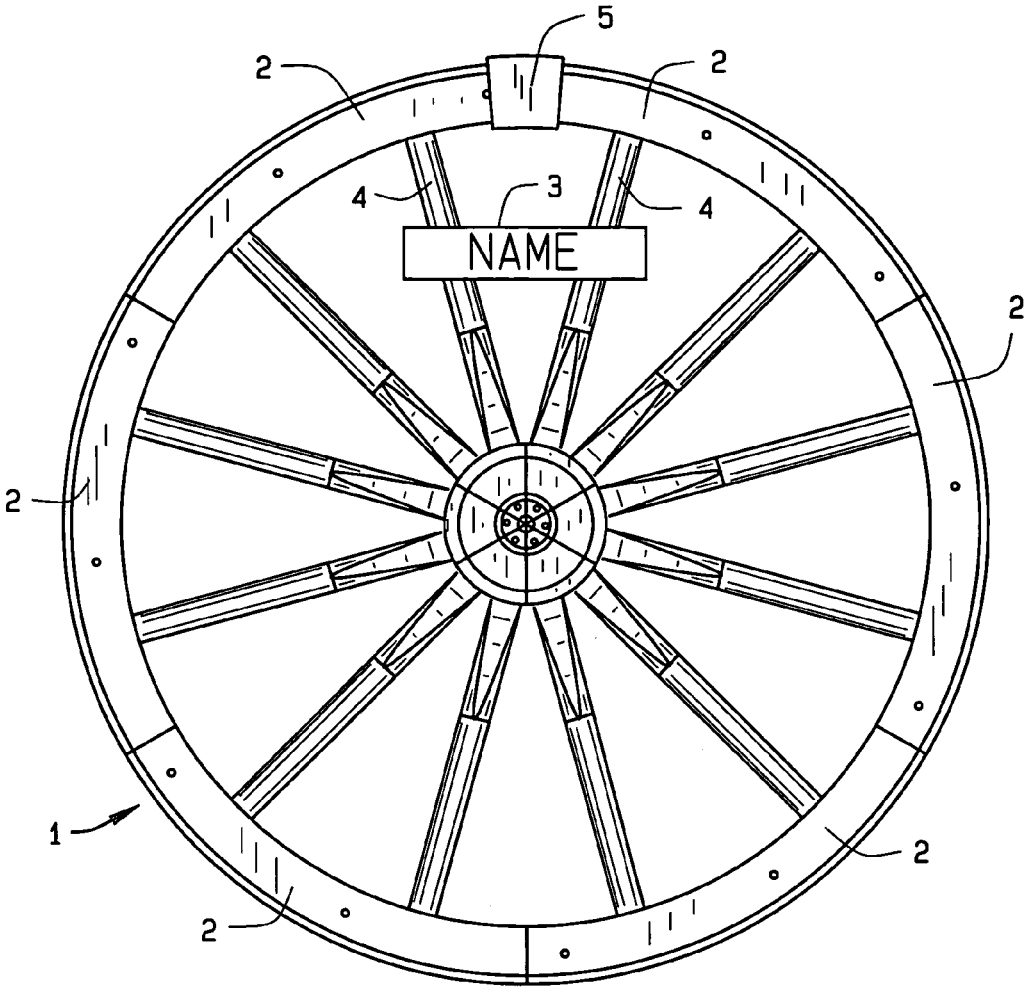
Figure 2:
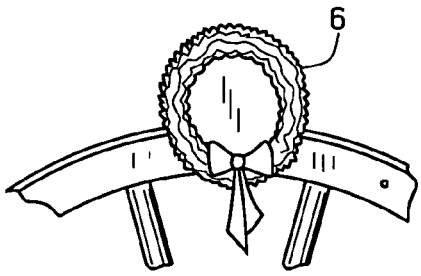
FIG. 2 is a front view of the segmented wagon wheel of this invention showing another decorative display.

In referring to the drawings and in particular FIGS. 1-8, the prefabricated and preassembled segmented wagon wheel 1 of this invention is readily disclosed. In this particular instance, it can be seen that the wagon wheel is segmented and assembled from various sections 2 as can be noted. In this particular instance, the wheel is used to display the name of the homeowner, as can be noted through the display 3, which may removable mount onto two of the spokes 4 of the assembled wheel. In addition, a mounting means, such as an aperture, is provided at 5, at the upper portion of the assembled segmented wheel, and therein various other decorative displays may be mounted, as to be described. For example, in FIG. 2, the display may include a mounted wreath 6.

Figure 3:
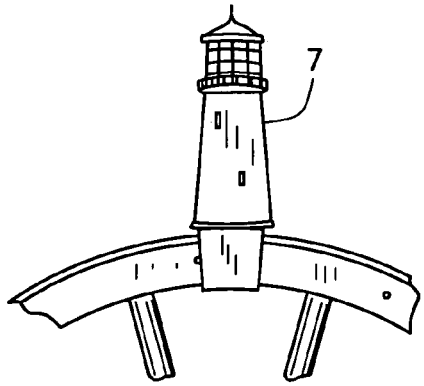
FIG. 3 is a front view of the segmented wagon wheel of this invention disclosing another decorative display.
Figure 4:
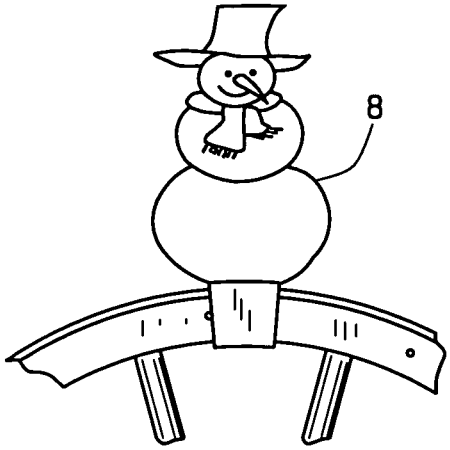
FIG. 4 is a front view of the segmented wagon wheel of this invention disclosing another decorative display.

In FIG. 3, the mounted decorative display may include a lighthouse 7. In FIG. 4, the decorative display may include a small resemblance of a snowman 8.

Figure 5:
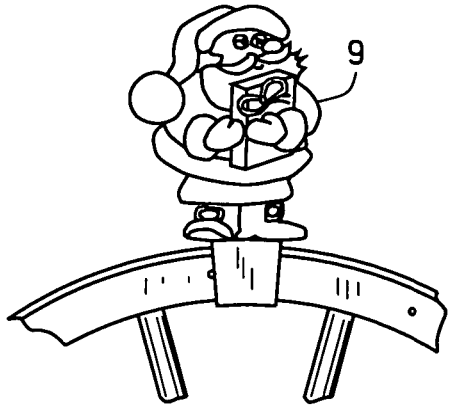
FIG. 5 is a front view of the segmented wagon wheel of this invention disclosing another decorative display.
Figure 6:
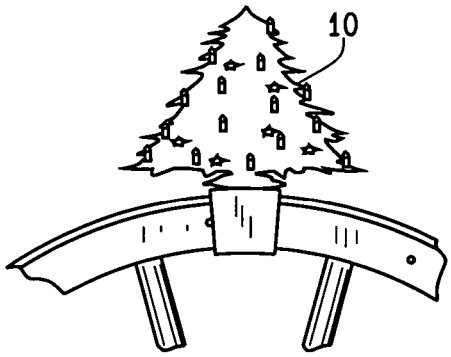
FIG. 6 is a front view of the segmented wagon wheel of this invention disclosing another decorative display.

In FIG. 5, as can noted the decorative display 9 may comprise a figurine of a Santa Clause. In FIG. 6, the decorative display may comprise a small Christmas tree 10.

Figure 7:
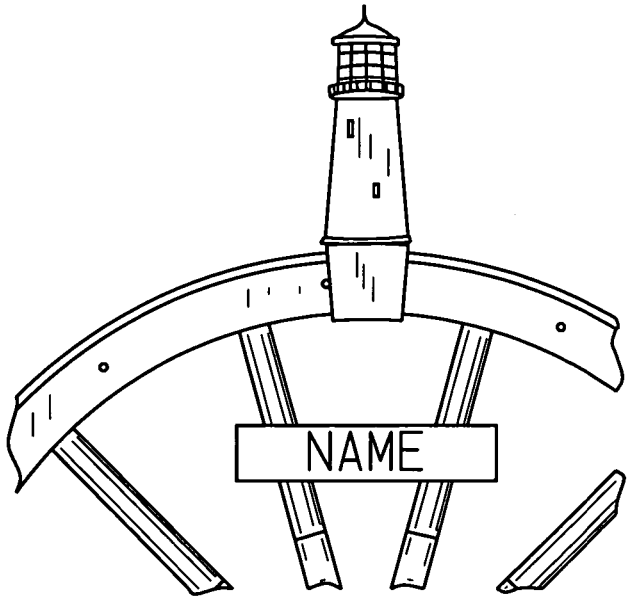
FIG. 7 is a front view of the segmented wagon wheel of this invention disclosing a combination of the name of occupant and a decorative display.
Figure 8:
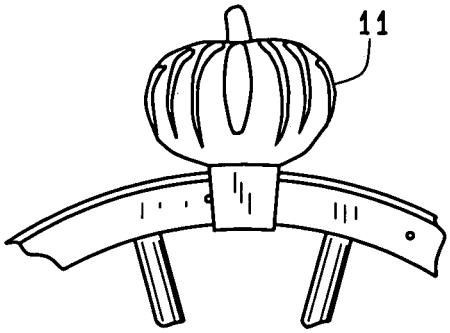
FIG. 8 is a front view of the segmented wagon wheel of this invention disclosing another decorative display

In FIG. 7, the decorative display may comprise of the occupant's name and a decorative display on top. And, in FIG. 8, the decorative display may include a pumpkin 11, as noted.

Essentially, as can be determined, from the pattern of displays as shown herein, and as described, that the displays may be seasonal, they may be removed and replaced into the erected segmented wagon wheel, during particular seasons, and be displayed for some time, during the duration of the season. This can simply be done by providing some type of a stem, boss, or some other mount, at the bottom of the decorative display, and which may insert into the socket or aperture provided along the upper periphery of the assembled wagon wheel, for ready display. And, it is also likely that more than one decorative display may be applied to more than one socket, or other fastening means, that may be provided around the periphery of the felle of the segmented wagon wheel.

Figure 9:
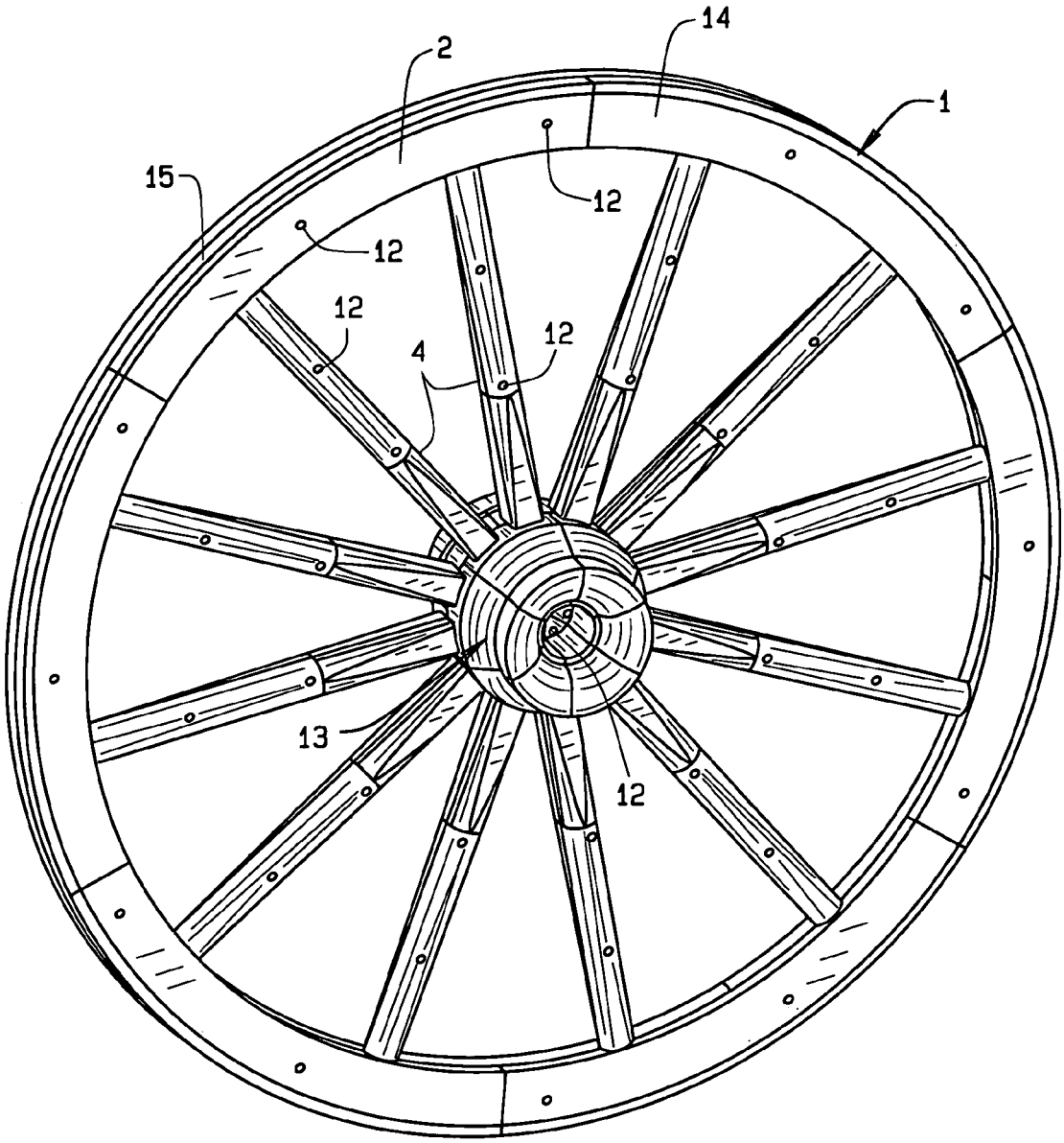
FIG. 9 is a perspective view of the assembled segmented wagon wheel of this invention.

The segmented wagon wheel 1 of this invention is further shown in the perspective view of FIG. 9. As disclosed, it can be seen that the segments to leach of which includes a pair of spokes 4, are assembled by means of fasteners, such as a plurality of screws 12 to the underline or back segments of the wheel that furnish the back half of the wheel. As can be noted, each assembled wheel includes a hub section 13, having a series of radiating spokes 4, and connects with an integrally assembled felle wheel and rim portion 14, as can be noted. In the assembled wheel, each segment which is integrally molded, it may be decoratively formed so as to furnish an outer metallic appearing rim 15, with the entire side surfaces of the felle 14, the spokes 4, all having a wood grain molded finish, to give the entire appearance of a wood facade to the assembled wheel, while the hub generally will be molded having a metallic and wood finish, that functions as the bearing for the wheel, in any authentic wagon wheel, when applied to the covered wagon, or the like.

Figure 10:
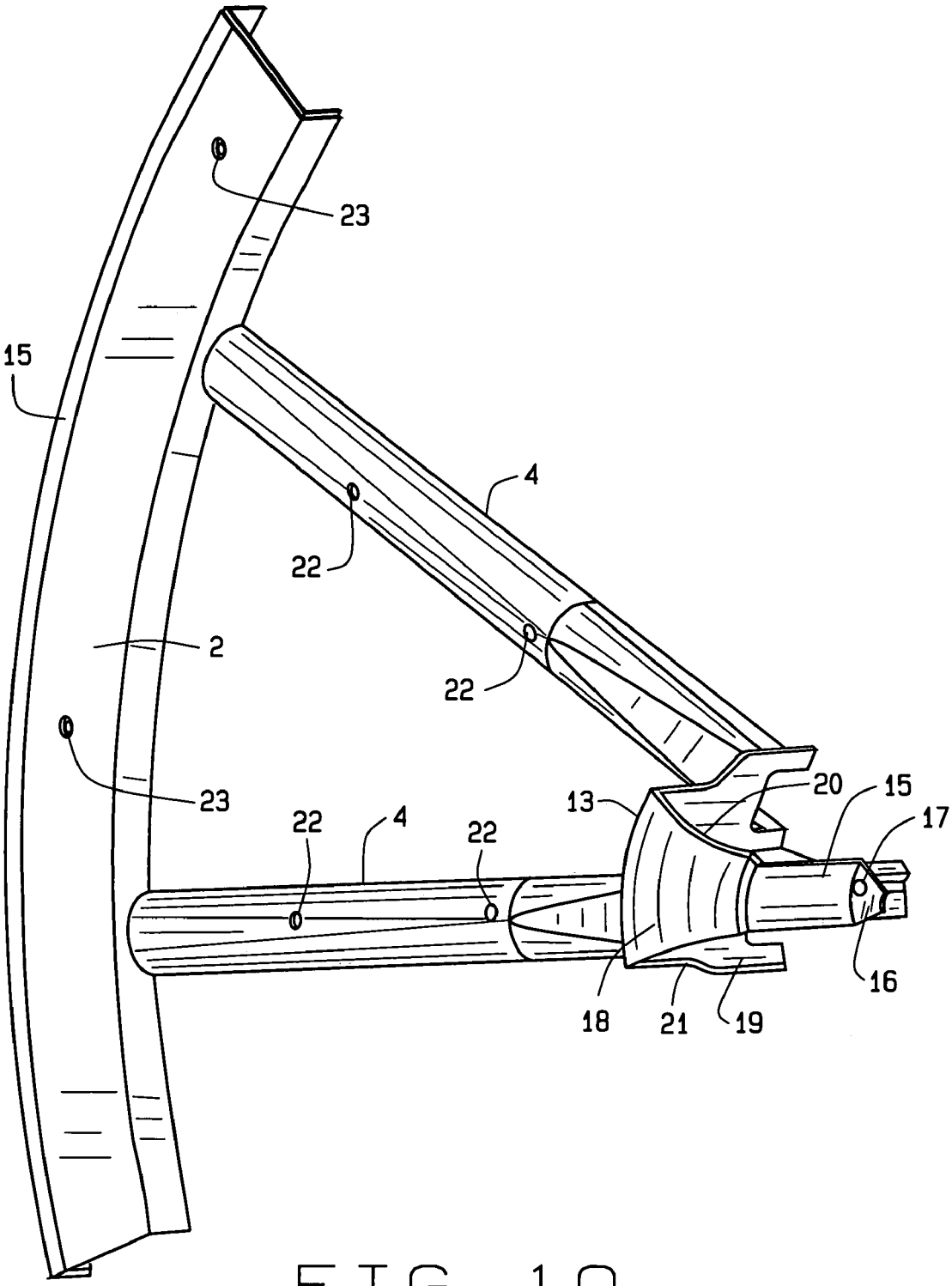
FIG. 10 is a front perspective view of one segment of the wagon wheel.

The particular segments that make up the wagon wheel of this design as shown in FIG. 10. This is a front view of one of the wagon wheel segments. As you can see, six such segments make up one side of the entire wheel. Corresponding six segments are assembled and fastened to the opposite side of the first half, in order to provide a complete wheel.

Figure 12:
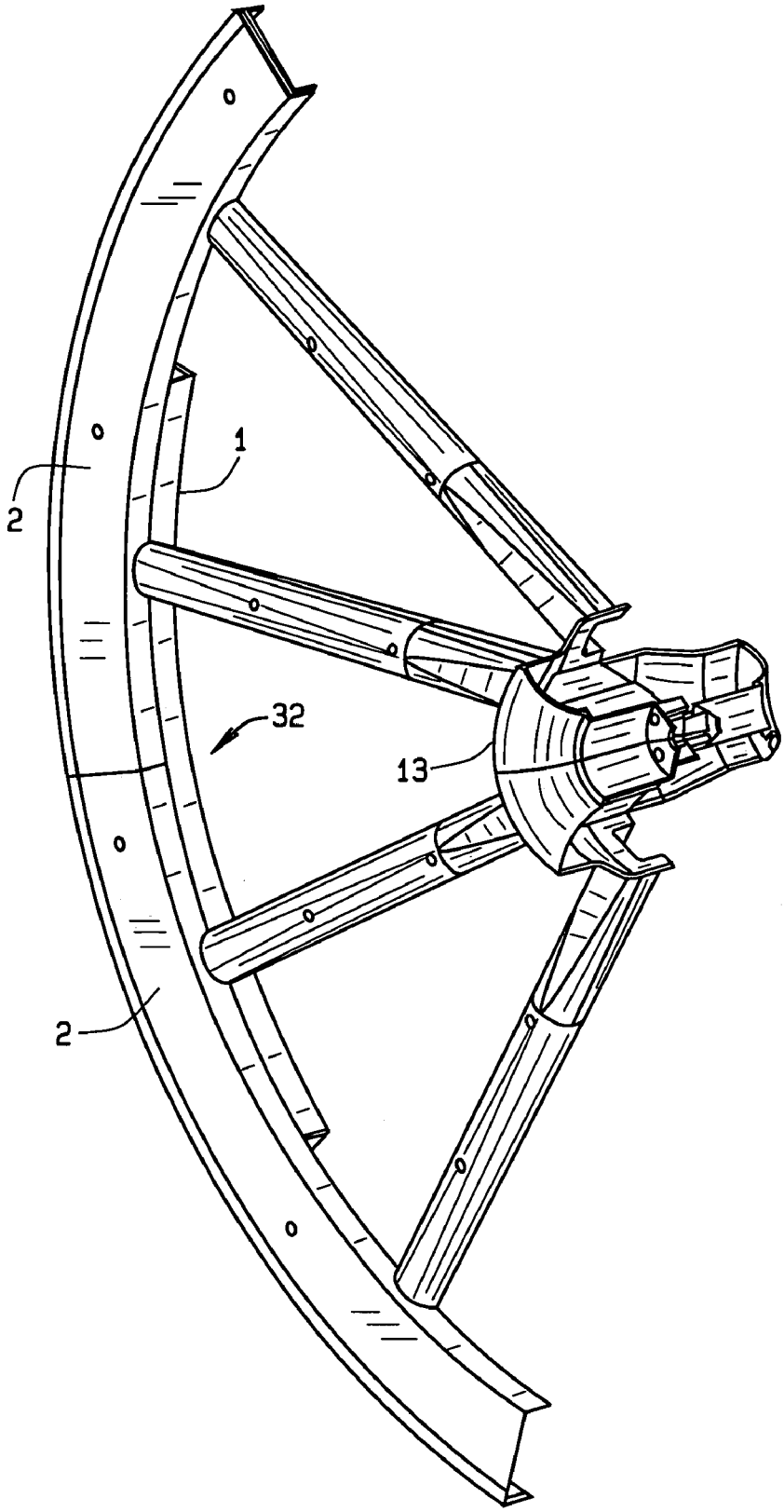
FIG. 12 is a front view of three segments of the wagon wheel during assembly.
Figure 13:
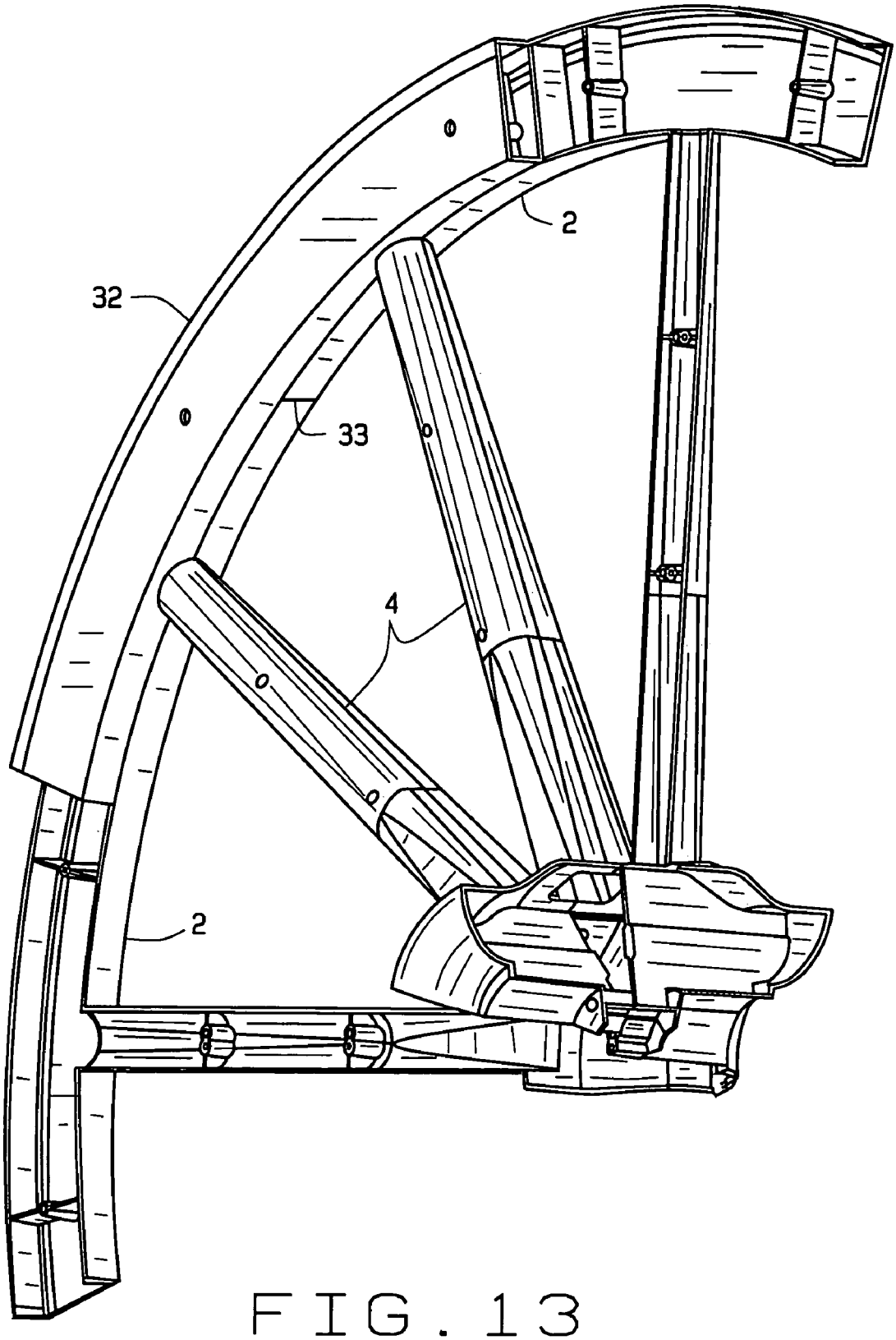
FIG. 13 is a back perspective view of three segments of the wagon wheel during assembly; with two segments fastened together with the third segments.

Being put together placing two segments face down and overlapping the third segment (face up) of the two facing down, as shown in FIGS. 12 and 13. As can be noted, the entire segment is integrally molded, as a one piece item. It includes a hub portion 13, which, is shaped in the configuration, along with the rest of each segment, into a pie shaped component, having an angular relationship in the range of a 60° degree sector of the entire one half of the assembled wheel. The front part of the hub segment, as at 15, includes a forwardly extending flange, as at 16, having an aperture of 17 providing therethrough, and through which a fastener, such as a screw, or fastener, may be secured, to the underlying segment, when the wheel is assembled. The hub segment is generally shaped in the configuration of a part of a hub for a wagon wheel. It included an upwardly and rearwardly extending arcuate surface 18 and which is formed into an outer wall 19, as can be noted. Along the entire edge of each side of the hub segment 13 are complimentary integrally extending flanges, as at 20, while the opposite edge as at 21, they have a slight offset, and perhaps slightly flared, so that the next segment of the hub can conveniently insert its flange 20, into the offset 21, so as to eliminate any seams for the hub as it is assembled. Extending integrally and radially outwardly from the hub, or the spokes 4, as can noted. Each of the spokes are half segments, or semi circular in design, when molded, and each includes, through its outer surface, the apertures 22 to accommodate the insertion of the fasteners or screws 12, as previously explained therethrough, when each of the front and back segments of the wagon wheel are being assembled, and secured together. At the outer edge of each spoke 4 is the segment for the felloe and rim 2, as previously reviewed. It also includes apertures 23 for accommodating screws are other fasteners therethrough, when assembling the front to the back segment of the wagon wheel, into an assembled structure. The felloe may include an outer rim like segment, as can be seen at 15, in order to give the appearance to the wagon wheel, of having an outer metallic rim, very similar to that which was previously provided in the old fashioned wagon wheel, when constructed many, many years ago.

Figure 11:
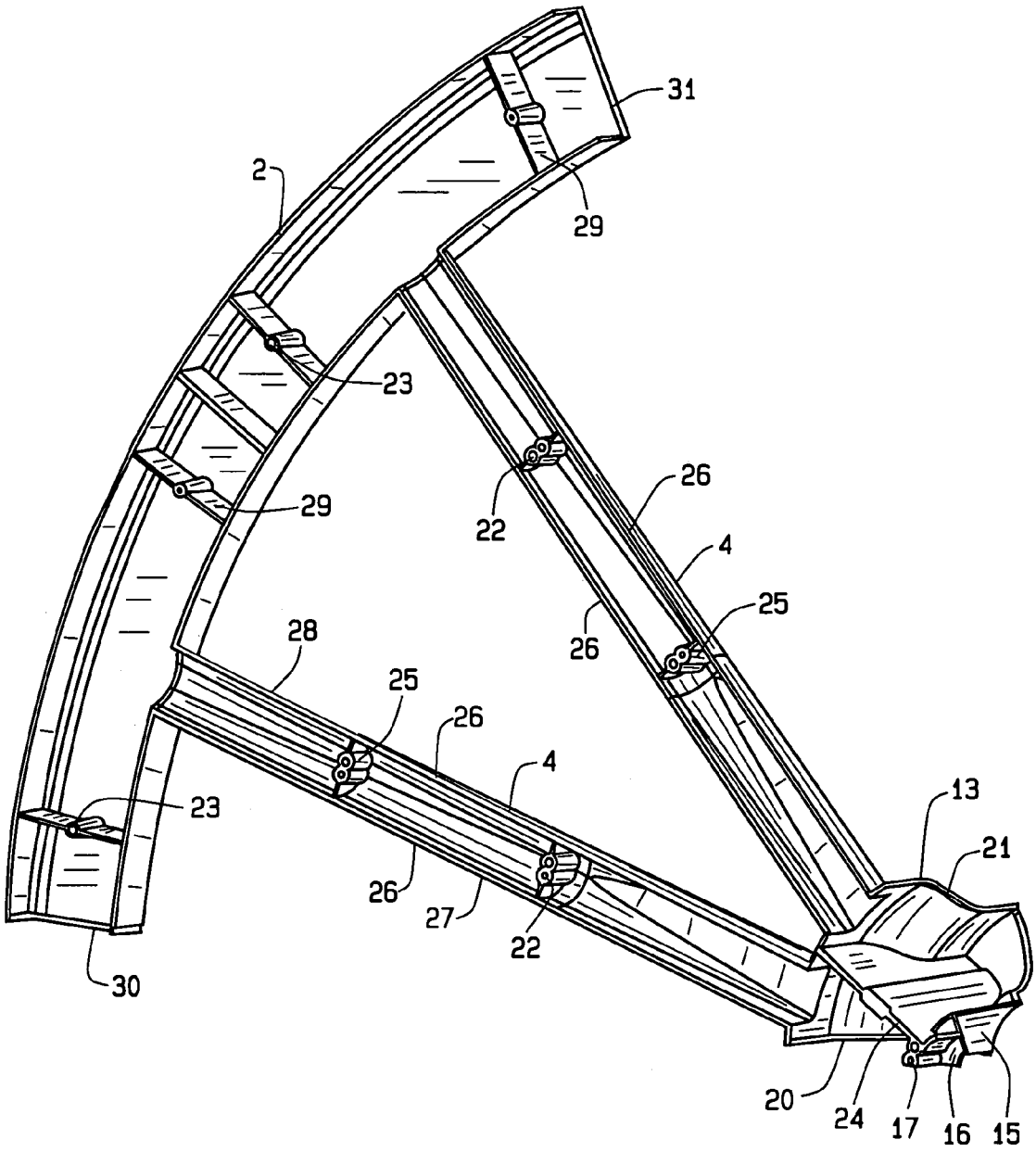
FIG. 11 is a back view of one segment of the wagon wheel.

The back side of each wagon wheel segment can be seen in FIG. 11. this includes the hub part, as previously explained, and which further includes a reinforcing brace, as at 24, between the inner part of the hub, as previously explained at 15, and the outer part of the hub, as at 13, in order to add reinforcement at this location. One or more of those apertures 17 can be seen, extending down from the flange portion 16 that accommodates the screws therethrough when assembling the segments together. Each of the spokes 4 as previously explained, is semi cylindrical in construction, when molded, and includes spaced but integrally formed bracing portions 25, and which have one or more of the apertures 22 provided therethrough, to accommodate one or more screws, when fastening the segments together. Provided along the entire length of the inner edge 26 of each spoke section is a tongue and groove arrangement, providing a groove, as along one edge, as can be noted at 27, with the tongue portion 28 provided upon the other edge, so that when segments of the spokes are brought together, they will interlock and interfit with each other, so as to provide for a uniform seam along their length and keep the spokes aligned, and held together, when the screws are inserted and tightened through the apertures 22.

Similarly, the extending flanges 20 can be seen along the edge of the hub segment, while the flared portions 21 are also noted, to provide for their interlocking together, when joined with adjacent hub sections.

The integrally molded outer fallow portion 2 also includes a series of braces 29, molded therein, and which provide the apertures 23 for accommodating screws when fastening the hub sections together. In addition, one side of the fallow, as at 30 likewise includes extending flanges, around their perimeter, while the opposite side includes an offset or flared portion 31, so that the flange of the next or adjacent hub section will insert within the offset portion 31, to eliminate the appearance of any seam, and to lock the segments of the fallows together, when assembled.

When assembling the wheel segments into an integral wheel structure, as can be seen in FIG. 12, a pair of the sections of the falloes 2 will be secured adjacent each other, and another section of a wheel, as at 1, will be located overlapping the pair of sections 2, as can be noted, and then all of the segments are screwed together, by means of fasteners, to form, as shown in this particular FIG. 12, a pair of segments being secured, during assembly, with an oppositely arranged segment, on the other side of the assembly. As can be noted, the hub begins to take shape in appearance, as seen at 13, while a complete falloe can be noted at the vicinity of 32 through this partial assembly.

As can be noted in FIG. 13, which is a view of the assembly of FIG. 12, from the opposite side, it can be seen that the two fallow segments 2 have the third segment 32 which overlaps the seam or ends 33 of the other tow fallow segments 2, during partial assembly. As can further be noted, due to the attachment of the wheel segment 32, to the two underlining segments, the entire spokes 4, will now have been completed in assembly.

Figure 14:
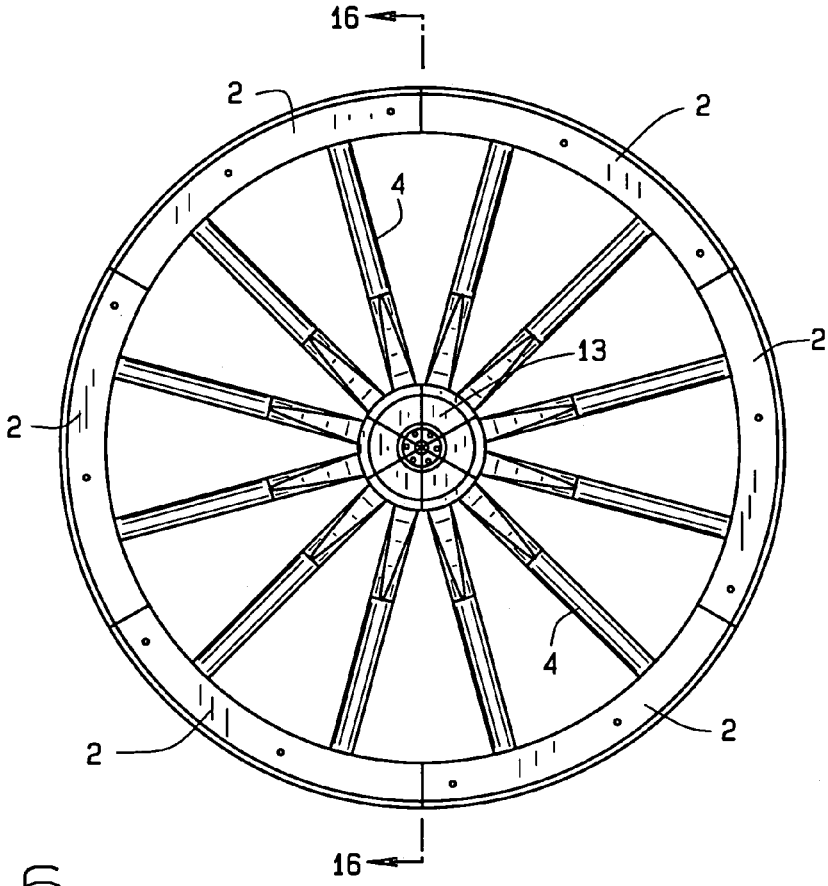
FIG. 14 is a front view of the assembled wagon wheel.

FIG. 14 discloses how the entire wheel is assembled, which includes six of the segments 2 on the front side of the wheel, and six of the similar type segments will be located upon the opposite side of the wheel, overlapping the front segments 2, to form a complete and integral wagon wheel assembly. As noted, in the assembled wheel, it will include twelve spokes 4 in its structure, all radiating from the assembled hub 13, as can be noted.

Figure 15:
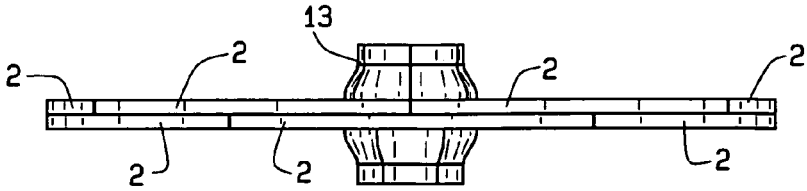
FIG. 15 is a top view of the assembled wagon wheel.

FIG. 15 discloses a top view of the assembled segmented wheel, and it can be seen how the various segments, as at 2, are arranged overlapping, in their structure, when the front and back portions of the wagon wheel are assembled, from these plurality of wheel segments. Yet, the entire segments form a singular hub 13, as can be noted.

Figure 16:
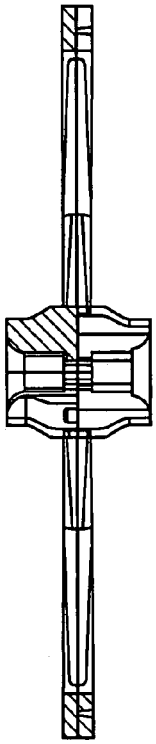
FIG. 16 is a sectional view of the assembled wagon wheel taken along the lines 16-16 of FIG. 14.

FIG. 16 provides a sectional view across the assembled segmented wheel, as can be seen.

Figure 17:
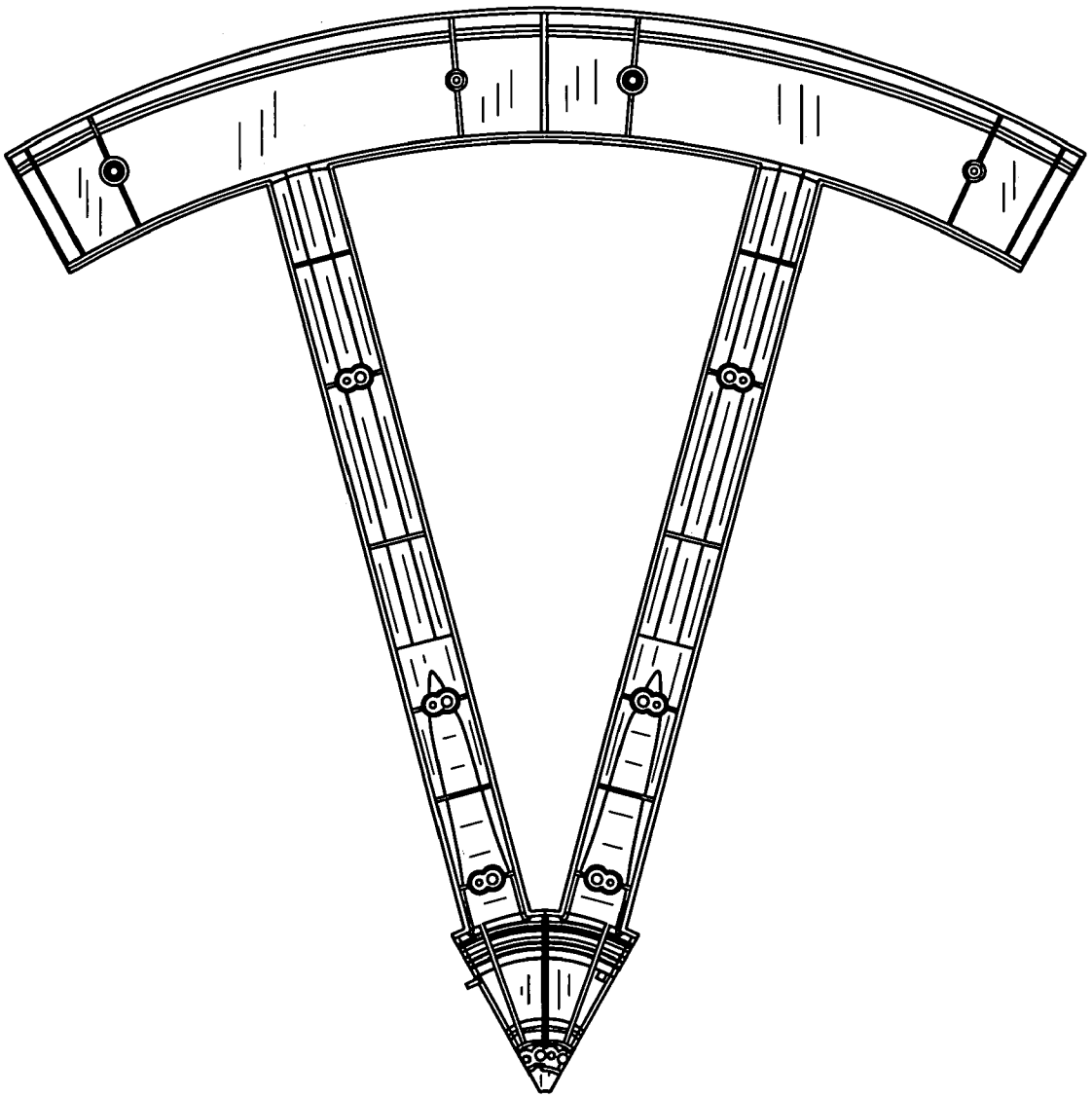
FIG. 17 is an interior view of one segment of the wagon wheel.

FIG. 17 provides an interior view of one segment of the designed wagon wheel.

It is also likely that the entire wheel assembly could be formed from various additional segments. For example, an integral hub may be molded at one time. The hub may include a series of sockets, and into which the spokes, as can be seen in FIG. 17 and 18, may insert. These spokes, as noted at 34, may be made of one piece, having an extending protrusion 35, and which may locate within the sockets of the formed hub. At the opposite end of each spoke, there may be provided an extension, as at 36, and which may locate within similar type sockets provided upon an outer ring shaped felloe, which may be formed integrally, or assembled from components, similar to that as previously described, and further including sockets into which the extensions 36 may locate, when assembling the entire segmented wagon wheel, into an integral structure.

The segmented wagon wheel of this design may be formed of any type of polymer, preferably molded into the components as previously described, or also may be formed of any neoprene or the like. Essentially, the designed wagon wheel is intended to be formed of a durable plastic or polymer, highly resistant to the elements, and therefore can provide for longevity when assembled and implanted partially into the ground, or perhaps staked to the ground, when it is located upon the front lawn or business for display, in the manner as previously described.

Variations or modifications to the subject matter of this invention may occur to those skilled in the art upon reviewing the disclosure as provided herein. Such variations, if within the concept of this development, are intended to be encompassed within the scope of the invention as set forth. The description of the preferred embodiment, even when viewed in conjunction with the drawings, is set forth for illustrative purposes only.

The invention claimed is:

1. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), each angular section of the wagon wheel having a partial rim portion, each section of the wheel having a partial hub portion, at least a pair of spokes extending integrally between the partial rim and hub portions, to provide an angular section of the wagon wheel design, wherein each partial rim portion has a first end and an opposite end, said first end having an extending flange, the opposite end having a flared end, such that when a pair of the angular sections of the wheel are mated together, the flange of one partial rim portion mates within the flared end of the opposite end of the partial rim portion of the next adjacent angular segment.

2. The segmented wagon wheel design of claim 1 wherein each angular section of the wagon wheel is formed of a polymer.

3. The segmented wagon wheel of design of claim 2 wherein the polymer is provided with a wood finish.

4. The segmented wagon wheel design of claim 3 wherein the angular section of the wagon wheel is colored.

5. The segmented wagon wheel design of claim 4 wherein the color is white.

6. The segmented wagon wheel design of claim 5 wherein the color is metallic.

7. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), each angular section of the wagon wheel having a partial rim portion, each section of the wheel having a partial hub portion, at least a pair of spokes extending integrally between the partial rim and hub portions, to provide an angular section of the wagon wheel design, wherein each angular section having a partial hub portion has two sides, one side of the hub portion having an integral flange, the opposite side of the partial hub having a flared end, whereby when a pair of the angular sections of the partial hub portions are adjoined together, the flange of one locates within the flared end of the other to provide an interconnection between sections as the wagon wheel structure is assembled.

8. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), each angular section of the wagon wheel having a partial rim portion, each section of the wheel having a partial hub portion, at least a pair of spokes extending integrally between the partial rim and hub portions, to provide an angular section of the wagon wheel design, wherein the spokes provided within an angular section of the wagon wheel having a pair of inner edges, an edge of one comprising a tongue, the inner edge of the other having a groove, such that when a wheel angular section mounts to the angular section of the opposite side of an assembled wheel to form a complete spoke, the tongue and groove edges intermate together to form a continuous and interconnected complete spoke.

9. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), each angular section of the wagon wheel having a partial rim portion, each section of the wheel having a partial hub portion, at least a pair of spokes extending integrally between the partial rim and hub portions, to provide an angular section of the wagon wheel design, wherein an assembled segmented wagon wheel forming a rim, hub, and spoke sections, with said rim, hub, and spoke sections provided with integral braces, the integral braces having apertures provided therein, a series of fasteners provided for interconnecting a pair of overlapping sections together when the wagon wheel structure is assembled.

10. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), each angular section of the wagon wheel having a partial rim portion, each section of the wheel having a partial hub portion, at least a pair of spokes extending integrally between the partial rim and hub portions, to provide an angular section of the wagon wheel design, wherein each angular segment of a rim, hub, and spokes of an assembled wheel incorporate additional integral bracing to reinforce each section as it is assembled into a complete wagon wheel structure.

11. A decorative wagon wheel for use as an ornamental display formed of various segments which once secured together form a complete wagon wheel structure, each segment comprising an angular section of one side of a wheel, such that when a plurality of said sections are secured together, on one side of the wheel, to overlap similar sections forming the opposite side of the wheel, and fastened together, the angular sections form an entire wagon wheel assembly, and each one angular section of a wheel extends approximately sixty degrees (60°), such that when the assembled wagon wheel is erected and displayed having an uppermost angular section, said uppermost angular section of the assembled wagon wheel having a mounting aperture provided therein, said mounting aperture provided for accommodating the attachment of a decorative design to the assembled wagon wheel.

12. The segmented wagon wheel design of claim 11 wherein said decorative design comprising a wreath.

13. The segmented wagon wheel design of claim 11 wherein the decorative design comprising a lighthouse.

14. The segmented wagon wheel design of claim 11 wherein the decorative design comprising a snowman.

15. The segmented wagon wheel design of claim 11 wherein the decorative design comprising a caricature of Santa Claus.

16. The segmented wagon wheel design of claim 11 wherein the decorative design comprising a pumpkin.

17. The segmented wagon wheel design of claim 11 wherein the decorative design comprising a name plate.

18. The segmented wagon wheel design of claim 11 wherein a name plate mounts to the assembled wagon wheel structure.

* * * * *